United States Patent [19]

Webley

[11] 4,072,875

[45] Feb. 7, 1978

[54] X-RAY TUBE

[75] Inventor: Reginald Sidney Webley, Hillingdon, England

[73] Assignee: EMI Limited, Hayes, England

[21] Appl. No.: 733,220

[22] Filed: Oct. 18, 1976

[30] Foreign Application Priority Data

Oct. 18, 1975 United Kingdom ..... 42867/75

[51] Int. Cl.[2] ..... H01J 35/10

[52] U.S. Cl. ..... 313/60; 313/149

[58] Field of Search ..... 313/60; 250/406, 416 TV

*Primary Examiner*—Rudolph V. Rolinec

*Assistant Examiner*—Darwin R. Hostetter

*Attorney, Agent, or Firm*—Cooper, Dunham, Clark, Griffin & Moran

[57] ABSTRACT

For certain applications it is desired to provide an X-ray tube in which the emitted X-rays can be scanned in relation to the fixed body of the tube. A rotating anode X-ray tube is described in which the periphery of the anode is so shaped that, in the course of rotation, the point of incidence of an electron beam moves relative to the tube as a whole. In response to this the emitted X-rays are similarly moved. Various shapes of anode can be used. In examples described one or more sections of equiangular spirals provide linear X-ray scans, with or without a rapid flyback.

9 Claims, 5 Drawing Figures

X-RAY TUBE

The present invention relates to sources of X-radiation and is especially related to such sources for use with scanning radiographic apparatus.

Conventional X-ray tubes include a source of a beam of electrons and an anode structure on which the electron beam is caused to be incident and which emits X-rays as a result of well known processes in response to the incident electrons. The anode may be a fixed structure although provision is usually made to change the anode if degradation resulting from heat generated by the electron beam becomes excessive. It is also known to provide a rotating anode which rotates about an axis to change the region of incidence thereon and thus improve the distribution of heat. The arrangement is however such that the region of incidence of the electrons, and hence the origin of the X-rays, is stationary in relation to the body of the tube so that the rotation of the anode does not disturb the X-ray emission.

In certain applications, in particular developments of the radiographic technique known as computerised Axial Tomography (CAT), it is required to provide a lateral scanning motion of a beam, usually fan shaped, of X-rays relative to a body being examined. This may, of course, be achieved by a lateral motion of the X-ray tube. However X-ray tubes have been proposed, for example in U.S. Pat. No. 4,002,917, in which the incident beam is scanned across the surface of a fixed anode to provide a corresponding scan of the emitted X-rays. This arrangement necessarily requires electron scanning equipment and associated control circuits to effect the said scan.

It is an object of this invention to provide an X-ray tube providing a scanned X-ray output which does not require a scanned electron beam.

According to the invention there is provided an X-ray tube including a movable anode, a source of a beam of energy, for example an electron beam, arranged to impinge on said anode to generate X-radiation substantially at a region of contact with said anode and means arranged to move said anode in a predetermined manner relative to other parts of the said tube to move the said region of contact relative to said other parts so that the generated X-radiation is scanned in a predetermined manner relative to the said tube.

Figure 1:
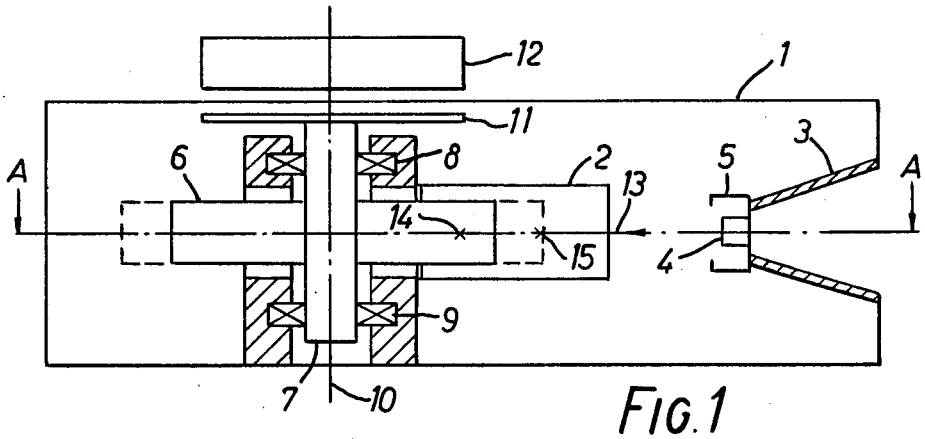
Figure 2:
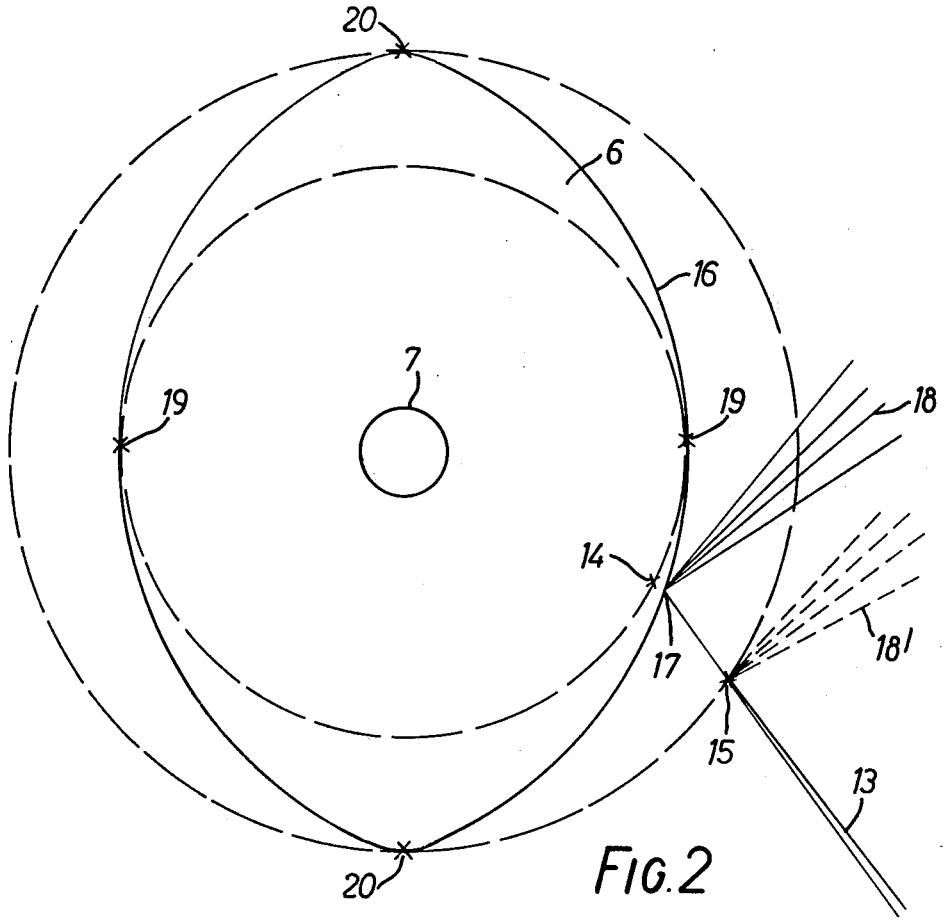
Figure 3:
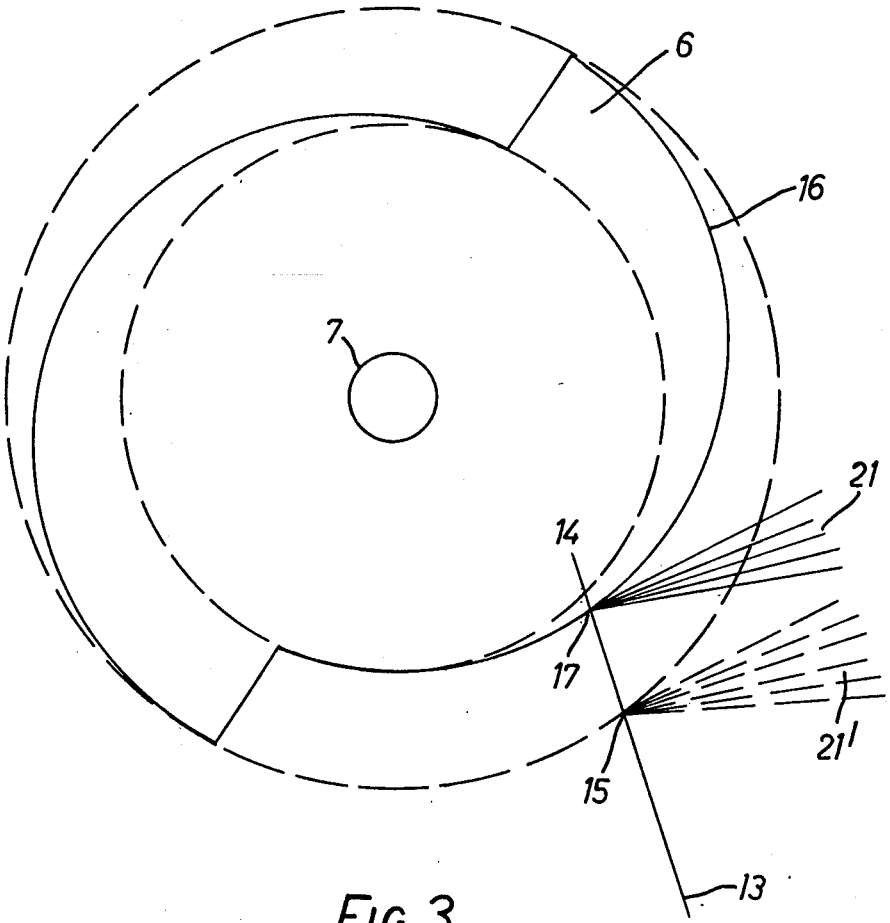

In order that the invention may be clearly understood and readily carried into effect embodiments thereof will now be described, by way of example, with reference to the accompanying drawings of which, FIG. 1 shows in simplified form a cross-section of a rotating anode X-ray tube adapted in accordance with the invention and, FIGS. 2 and 3 show in plan view forms of anode suitable for use with the tube of FIG. 1.

Figure 4A:
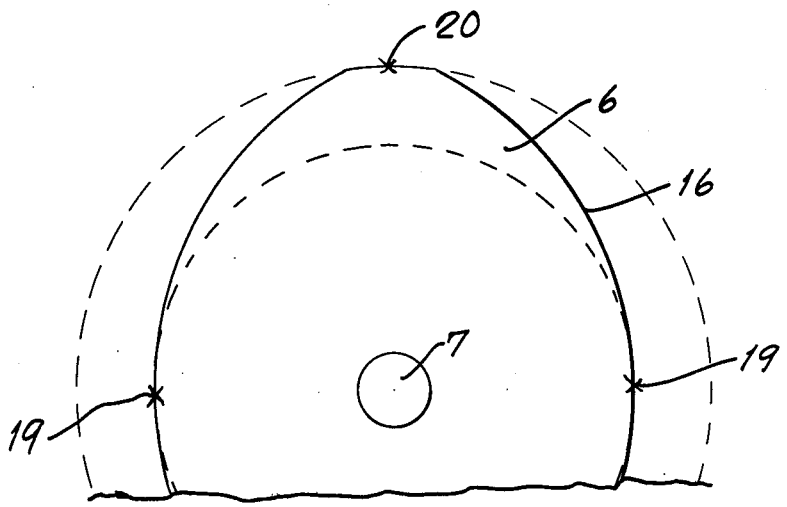
Figure 4B:
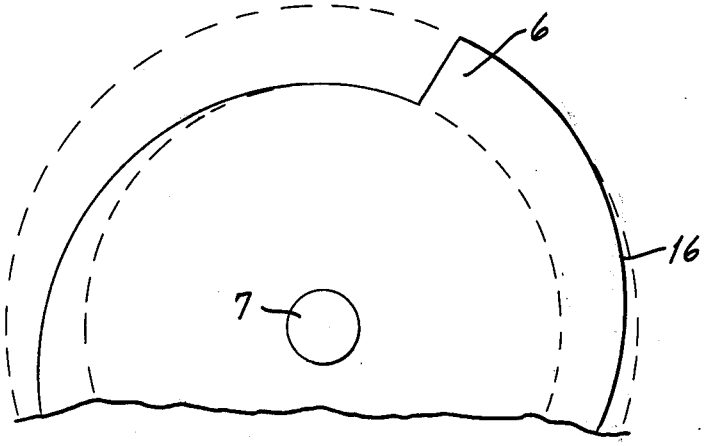

FIGS. 4*a* and 4*b* show, in partial plan view, modified forms of the anode shown in FIGS. 2 and 3 respectively.

To provide the scanned X-ray emission it is proposed to adapt the known rotating anode X-ray tube. The arrangement is such that, for a fixed beam of electrons, the region of incidence of electrons on the anode is moved relative to the fixed parts of the tube in the course of the rotation, unlike the known tubes for which it remains stationary.

There is shown in FIG. 1 a rotating anode tube so adapted. The tube comprises an evacuated envelope 1 which includes a portion 2, transparent to X-rays, situated in the wall to the rear of the section shown in the drawing. An insulating part 3 of the envelope 1 supports a cathode 4 and, adjacent thereto, an electrode 5 which can be energized to act as a guard plate, control grid or focus electrode. Conventional electrical connections (not shown) are provided to the cathode 4 and electrode 5. An anode 6 is mounted on a shaft 7 journalled in bearings 8 and 9 to rotate about an axis 10 in the plane of the drawing. Rotation is produced in known manner by the cooperation of a rotor 11 mounted on shaft 7 and a stator 12 mounted adjacent to and concentric with stator 11 but outside envelope 1. Means (not shown) are also provided to apply required electrical potentials to anode 6.

In operation cathode 4 and electrode 5 co-operate to provide an electron beam 13 directed toward and preferably focussed at the anode 6 to generate X-radiation at the surface thereof. Electron beam 13 has been shown as a pencil beam but it will be understood that it may be a known form of ribbon beam having a larger dimension in one direction perpendicular to its direction of travel.

The X-ray tube and operation so far described are essentially the same as a known rotating anode tube. However in this example the anode is appropriately shaped, for example as will be described hereinafter, so that in the course of rotation the position at which the electron beam strikes the anode is moved. Thus, as rotation takes the anode from the position shown in solid line to that shown in broken line, the point of origin moves from position 14 to position 15. The movement is in the plane of the paper along the axis of the electron beam. The radiation is emergent through the window 2 and is available for any desired purpose such as for example CAT purposes for which typically the radiation will be collimated into a fan shaped spread, in plane AA, from each successive point of origin.

Two anode shapes capable of producing the desired scanning effect are shown in more detail in plan views in FIG. 2 and 3. In FIG. 2 the anode 6 effectively comprises four quadrants each having a curved periphery to form a surface 16. The four periphery sections may be generally elliptical but in this example are each the same part of an equiangular spiral, two being in one sense and two in the opposite sense. In a typical embodiment the anode could be ten inches minimum diameter and fourteen inches maximum diameter for a tube operating at up to 400 kV and ⅓A. The electron beam is directed at the surface 16 in the direction shown and is incident 17 to provide X-rays 18. As is conventional in X-ray tubes of this class it is expected that the X-rays will be derived perpendicularly to the incident electron beam 13 although the maximum of X-ray emission will not usually be in that direction. For that reason X-rays 18 have been shown as a fan shaped spread in the perpendicular direction although collimator means for that purpose will usually be situated external to the X-ray tube envelope 1.

The anode is rotated about the axis 7 so that the point of origin of the X-rays varies from point 14 to point 15 as the point on the periphery 16 intersecting electrons 13 varies between points 19 and points 20 respectively. Thus the position of the emitted X-rays is moved parallel to the electron beam the X-rays for position 15 being indicated at 18[1]. If the electrons are focussed on the anode surface it may be desirable to vary the focus of the beam as the point of contact with the anode moves. Such adjustment can be provided by conventional electromagnetic or electrostatic means, linked to the rotation of the anode, for example by use of the waveform provided to anode stator 12.

FIG. 3 shows an alternative form of anode 6. In this example the anode surface is formed of two sections of equiangular spirals in the same sense so that the periphery 16 intersects the electron beam at points between extremes 14 and 15 during rotation of the anode. The corresponding X-ray emission which is shown at 21 for an intermediate source point 17 scans between a first limit corresponding to source point 14 and a second limit 21' corresponding to source point 15. Since the two sections shown are spirals in the same sense they provide a steady scan of the X-rays over that range, for clockwise rotation of the anode 6, with a rapid flyback from 21' to the first limit. The arrangement of FIG. 2 provides, however, steady scans in alternate directions between the two extremes. The arrangement is otherwise generally the same for the two anode shapes.

For both anode shapes equiangular spirals have been shown to give linear scans as a function of time for a constant angular velocity of the anode. Other shapes can however be used to give other desired scanning rates or forms. For CAT purposes the anodes illustrated may require to rotate at up to 30,000 rpm to give required X-ray scan rates. However anodes may be provided with larger numbers of facets to allow the faster scan rates without such high rotation rates. The rotation should, however, be sufficiently fast to allow proper cooling of the anode as in conventional rotating anode tubes.

It should also be noted that the arrangements shown assume that the X-rays are derived in a direction perpendicular to the incident electron beam. However, if X-rays are derived in other directions the scan provided will also give a displacement of the point of origin along the mean direction of the derived X-rays.

As an additional feature part of the surface of the anode surface may be provided at a constant radius so that the X-ray fan can "dwell" at one position of the scan for a selected time, as illustrated in FIGS. 4*a* and 4*b*.

The anodes shown have a surface parallel to the axis of rotation, unlike conventional rotating anode tubes. However the surface can be inclined to that axis if desired.

Although the electron beam is shown normal to the anode axis, providing an X-ray scan in plane AA, it will be understood that this is not an absolute condition of the invention but can be varied if desired.

In an alternative embodiment the speed of X-ray scan may be changed by providing a variable rate of rotation for anode 6.

Although the invention has been described with reference to a particular tube geometry and source of electrons to generate X-rays from an anode, other geometrics and sources, for example a laser, of radiation incident on the anode, could be used in putting the invention into effect.

No specific form of cathode has been discussed since this may be of any known form. For example the cathode described in U.S. Pat. application Ser. No. 731,428 filed Oct. 12, 1976 may be used to provide a high power electron beam.

It should be appreciated that, in the course of the scanning motion the direction of emission of X-rays, in relation to the normal to the anode surface, may change causing a variation in the hardness of X-rays in some parts of the fan selected. This is particularly true of the anode form of FIG. 2. For certain purposes, for example CAT scanning, means should be provided to correct or compensate for such variations. If desired an anode with only one spiral section may be provided.

What I claim is:

1. An X-ray tube including an envelope and an anode movable with respect thereto, a source of a beam of energy, for example an electron beam, arranged to impinge on said anode to generate X-radiation substantially at a region of contact with said anode and means for moving said anode in a predetermined manner relative to said tube envelope to move said region of contact relative to said tube envelope to scan the generated X-radiation in a predetermined manner relative to said tube envelope.

2. An X-ray tube according to claim 1 in which said anode is rotatable about an axis and is formed with a peripheral surface at a variable radius from said axis and said means for moving comprises means for rotating said anode about said axis to move said region of contact relative to the tube envelope.

3. An X-ray tube according to claim 2 in which the anode is a disc with a substantially elliptical plan form perpendicular to said axis.

4. An X-ray tube according to claim 2 in which the periphery of the anode includes one or more sections of substantially equiangular spiral form in a plane perpendicular to said axis.

5. An X-ray tube according to claim 2 in which the periphery of the anode includes one or more sections of substantially constant radius about said axis in a plane substantially perpendicular thereto.

6. An X-ray tube according to claim 2 in which said source includes means for directing said beam of energy along a path intersecting said anode at a tangent to a circle concentric with said axis.

7. An X-ray tube according to claim 2 in which said means for moving includes means for rotating said anode about said axis at a substantially constant angular velocity.

8. An X-ray tube according to claim 1 in which said anode is formed with a surface shaped so that the movement of said region of contact comprises a series of steady movements in one direction with a rapid flyback in the other direction therebetween.

9. An X-ray generating tube comprising an evacuated envelope, an anode mounted inside the envelope for rotation about an anode axis and having a peripheral surface at least partially surrounding said axis, a source of an electron beam propagating at least some of the time along a beam axis fixed with respect to the envelope and impinging on said peripheral surface at an area which moves along the peripheral surface upon rotation of the anode about said anode axis, said peripheral surface being irregularly shaped to cause said area of impingement of the electron beam to move with respect to the envelope upon rotation of the anode, said peripheral surface being made of a material generating X-ray radiation when said electron beam impinges thereon, said X-ray radiation originating at the area of impingement and propagating away from the anode, and means for rotating the anode about the anode axis to thereby move the area of impingement relative to the envelope and scan the X-ray radiation relative to the envelope in a manner determined by the shape of the peripheral surface and the anode rotation.

* * * * *